US008056942B2

(12) United States Patent
Marini et al.

(10) Patent No.: US 8,056,942 B2
(45) Date of Patent: Nov. 15, 2011

(54) LOCK

(75) Inventors: Aexander Marini, Rheinfelden (DE); Andy Junge, Kandern (DE); Rene Dreiocker, Kandern (DE)

(73) Assignee: A. Raymond et Cie, Grenoble (FR)

( * ) Notice: Subject to any disclaimer, the term of this patent is extended or adjusted under 35 U.S.C. 154(b) by 819 days.

(21) Appl. No.: 12/090,283

(22) PCT Filed: Sep. 14, 2006

(86) PCT No.: PCT/EP2006/008937

§ 371 (c)(1),
(2), (4) Date: Apr. 15, 2008

(87) PCT Pub. No.: WO2007/045314

PCT Pub. Date: Apr. 26, 2007

(65) Prior Publication Data

US 2008/0276670 A1 Nov. 13, 2008

(30) Foreign Application Priority Data

Oct. 22, 2005 (DE) ..... 10 2005 050 734

(51) Int. Cl.
*E05C 19/02* (2006.01)
*E05B 15/02* (2006.01)

(52) U.S. Cl. ..... 292/80; 292/85; 292/87; 292/341.18; 292/DIG. 38; 292/DIG. 60; 292/DIG. 63

(58) Field of Classification Search ..... 292/80, 292/81, 84, 85, 87, 89, 341.18, 341.19, DIG. 38, 292/DIG. 60, DIG. 63, 100
See application file for complete search history.

(56) References Cited

U.S. PATENT DOCUMENTS

| | | | | | |
|---|---|---|---|---|---|
| 2,469,113 | A | * | 5/1949 | Hooker | 292/332 |
| 3,705,738 | A | | 12/1972 | Yoshimura | |
| 3,868,836 | A | | 3/1975 | La Roche | |
| 4,216,983 | A | * | 8/1980 | Hough et al. | 292/263 |
| 4,542,924 | A | * | 9/1985 | Brown et al. | 292/87 |
| 4,832,384 | A | * | 5/1989 | Venable | 292/87 |
| 4,906,037 | A | * | 3/1990 | Stammreich et al. | 292/341.18 |
| 5,172,945 | A | | 12/1992 | Doherty et al. | |
| 5,226,302 | A | * | 7/1993 | Anderson | 70/159 |
| 5,352,001 | A | * | 10/1994 | Shieh | 292/57 |
| 5,478,126 | A | * | 12/1995 | Laesch | 292/87 |
| 5,775,749 | A | * | 7/1998 | Reithmeyer et al. | 292/341.18 |
| 6,053,544 | A | * | 4/2000 | Alvring et al. | 292/203 |
| 6,568,719 | B2 | * | 5/2003 | Buscella | 292/85 |
| 6,612,625 | B1 | * | 9/2003 | Barber et al. | 292/87 |
| 7,360,810 | B2 | * | 4/2008 | Dennis | 292/341.18 |

FOREIGN PATENT DOCUMENTS

DE 2048206A1 A1 5/1971

(Continued)

*Primary Examiner* — Carlos Lugo
(74) *Attorney, Agent, or Firm* — Baker & Daniels LLP

(57) ABSTRACT

A lock for releasably locking a movable hatch to a counterpart is equipped with a fitting (1) having a locking assembly (21) and an additional fitting (2) having an additional locking assembly (28) that can be brought into engagement with the locking assembly (21) of the other fitting (1). The fittings (1, 2) are made of plastic and an elastically deformable compensating cushion (7) is present, which is fastened to one fitting (1, 2) and which when the fittings (1, 2) are in the locked position is disposed deformed between the fittings (1, 2) such that it exerts a bias on them (1, 2). The inventive lock is therefore light but strong and compensates tolerances.

5 Claims, 2 Drawing Sheets

FOREIGN PATENT DOCUMENTS

| | | | |
|---|---|---|---|
| DE | 2641338A1 | A1 | 3/1977 |
| DE | 10233802A1 | A1 | 2/2004 |
| DE | 10351424 | A1 | 6/2004 |
| GB | 626416A | A | 7/1949 |
| GB | 1515320 | | 6/1978 |
| GB | 2396656A | A | 6/2004 |

* cited by examiner

LOCK

RELATED APPLICATION

This application is a U.S. National Phase Patent Application based on International Application Serial No. PCT/US2006/008937 filed Sep. 14, 2006, the disclosure of which is hereby explicitly incorporated by reference herein.

BACKGROUND OF THE INVENTION

1. Field of the Invention

The present invention provides a lock for releasably locking a movable hatch to a counterpart.

2. Description of the Related Art

Such locks, which are typically used in automotive construction, are conventionally made of metal. A fitting of the lock can be connected to the movable hatch and comprises a locking assembly with a pin that can be releasably locked to a locking assembly of an additional fitting of the lock that is connected to a counterpart. The pin in this case is configured as relatively sturdy, since it has to be able to withstand both tensile and compressive stresses.

SUMMARY OF THE INVENTION

The present invention provides a lock that is light but strong and that compensates tolerances.

By virtue of the fact that in the lock according to the invention, the fittings are made of plastic and an elastic compensating cushion is present which in the locked position of the fittings generates a bias that acts on the fittings, the only stress exerted between the fittings is a tensile stress, and this can be absorbed unproblematically in the case of plastic fittings without having to make the locking assemblies of the fittings excessively sturdy. As a result, for one thing, the lock according to the invention is comparatively light while still being sufficiently strong, and for another, tolerance compensation between the fittings is achieved by means of the deformable compensating cushion and the various adjustable spacing increments in the direction of relative movement of the fittings.

In one form thereof, the present invention provides a lock for releasably locking a movable hatch to a counterpart, the lock including a fitting having a locking assembly and an additional fitting having an additional locking assembly that can be brought into engagement with the locking assembly of the other fitting, characterized in that the fittings are made of plastic and in that an elastically deformable compensating cushion is present, which is fastened to one fitting and when the fittings are in the locked position is disposed deformed between the fittings such that it exerts a bias on the fittings, and in that one locking assembly has an elongate locking element that can be adjusted in a number of spacing increments in the longitudinal direction.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
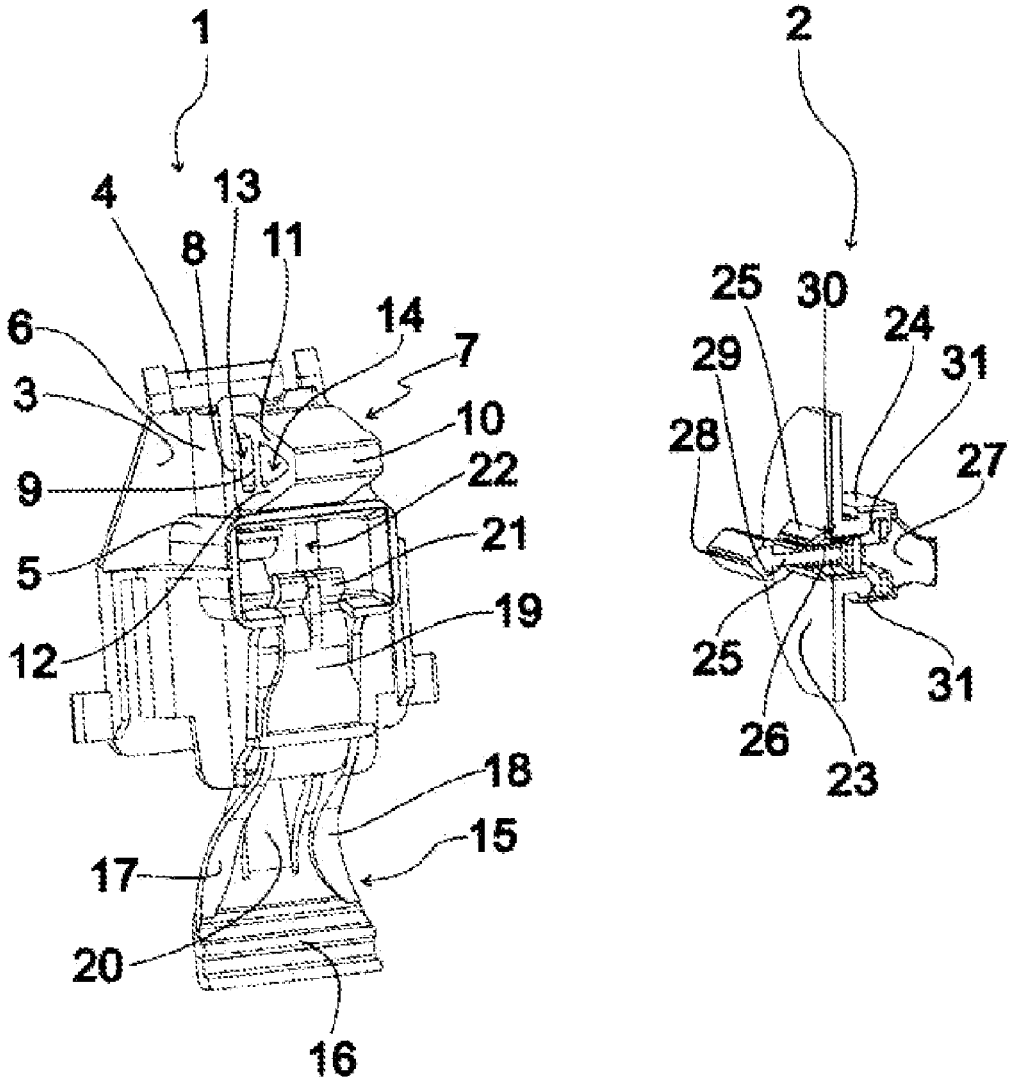
FIG. 1 is a perspective view of an exemplary embodiment of a lock according to the invention comprising, as fittings, a hatch fitting and an autobody fitting, in an unlocked position.

Corresponding reference characters indicate corresponding parts throughout the several views. Although the exemplifications set out herein illustrate an embodiment of the invention, the embodiment disclosed below is not intended to be exhaustive or to be construed as limiting the scope of the invention to the precise forms disclosed.

DETAILED DESCRIPTION

FIG. 1 is a perspective view of an exemplary embodiment of a lock according to the invention, comprising as fittings a hatch fitting 1 and an autobody fitting 2. In this exemplary embodiment, the autobody fitting 2 can be fastened to the autobody, serving as counterpart, of a motor vehicle not illustrated in FIG. 1, whereas the hatch fitting 1 can be mounted on the hood of the vehicle, functioning as the hatch. Both fittings 1, 2 are made of a hard plastic material.

The hatch fitting 1 comprises a base plate 3, on which is formed in an end region, to effect connection to the hood, a fastening hook 4 that serves to connect the hatch fitting 1 to the hatch in this end region. In addition, attached to the base plate 3 is a substantially cuboid hook receiving housing 5, which for stiffening purposes is braced edgewise by webs, and which on its side facing away from the base plate 3 is configured as open and with an edge that widens slightly.

Adjacent the receiving housing 5 is a cushion base 6, which is connected to the base plate 3 and rises above it, and into which, as a separate part of the inventive lock, a deformable, one-piece compensating cushion 7 made of a resilient elastic material can be inserted by being pushed in from one side.

The compensating cushion 7 comprises a base web 8 that is connected to the cushion base 6, an intermediate web 9 that is oriented substantially parallel to the base web 8, and a front web 10 that is shorter than intermediate web 9 and is disposed on the opposite side of it from base web 8, which are connected to one another via edge webs 11, 12 joined to their edge sides. A cavity 13 thus is formed between base web 8 and intermediate web 9, and a cushioning space 14 between intermediate web 9 and front web 10.

Furthermore, hatch fitting 1 is equipped with an unlocking lever 15 that is part of a locking assembly and can be moved between a locking position and a releasing position, and that comprises a marginally disposed operating tongue 16. Operating tongue 16 is disposed roughly in the plane of base plate 3 and is connected to a tongue leaf 19 via two marginally disposed connecting webs 17, 18 extending away from base plate 3. Disposed between the connecting webs 17, 18 is a lever spring tongue 20, which is attached by one end to operating tongue 16 and whose free end is bent away from connecting webs 17, 18 in the direction of the base plate 3. Formed on the side of tongue leaf 19 facing away from connecting webs 17, 18 is a locking tongue 21, which is part of the locking assembly of hatch fitting 1 and which extends through a clearance in hook receiving housing 5 into a housing well 22 that is surrounded by hook receiving housing 5.

To prevent paintwork damage due to the compensating cushion 7, the autobody fitting 2 is configured with a roughly semicircular pressure guard plate 23 having a roughly rectangular recess that is open at the edges. Attached to a flat side of pressure guard plate 23, at the edge of the recess, is a hook fixing housing 24. Formed at the edge of the recess on the opposite side of pressure guard plate 23 from hook fixing housing 24 are two mutually opposite tooth prolongations 25, which extend away from pressure guard plate 23 and toward each other and comprise fixing lips 26. On the side facing away from pressure guard plate 23, a latching tongue 27 to effect connection to the autobody is formed as a counterpart on hook fixing housing 24. Hook fixing housing 24 can be removed from the autobody by lifting latching tongue 27.

In the exemplary embodiment shown, a locking assembly of autobody fitting 2 comprises, as an elongate locking element, an elongate locking hook 28 configured with projections that jut out on both sides, for left/right installation. The locking hook 28 is attached at one end to a shaft 29 having a substantially rectangular cross section, which in the arrangement according to FIG. 1 extends through the recess in pressure guard plate 23 and into hook fixing housing 24. Shaft 29 is configured with a number of fixing ribs 30, which extend parallel to one another along the flat sides of the shaft 29 and which, on the insertion of shaft 29 into the recess in pressure guard plate 23, come into engagement with fixing lips 26 configured in hook fixing housing 24, such that the spacing between locking hook 28 and pressure guard plate 23 can be adjusted in spacing increments and the shaft 29 is secured against movement in the longitudinal direction.

A positioning tolerance in the other two directions is also conferred by the sufficiently largely dimensioned space in housing well 22.

It can further be appreciated from FIG. 1 that when the shaft 29 is properly inserted into the recess in pressure guard plate 23, locking tongues 31 configured with gripping ends engage behind the hook fixing housing 24, thereby further securing shaft 29 against movement opposite to the insertion direction. To remove the shaft 29 from this engagement, the locking tongues 31 must be pressed together until the shaft 29 is released, so that the shaft 29 can be withdrawn from hook fixing housing 24 against the direction of insertion.

Figure 2:
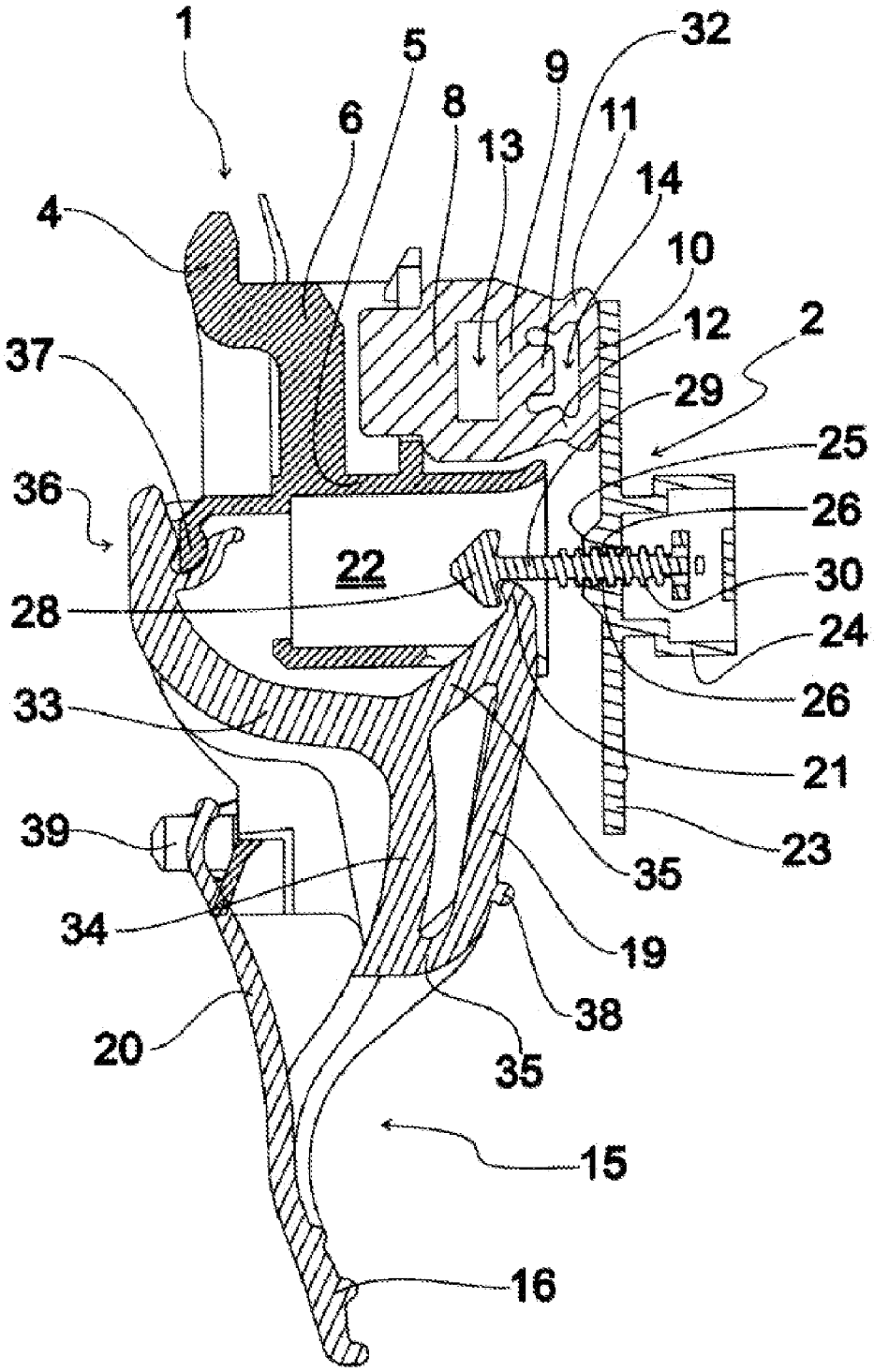
FIG. 2 shows the exemplary embodiment according to FIG. 1 in section, with the fittings in a locked position.

FIG. 2 is a section of the hatch fitting 1 and the autobody fitting 2 according to FIG. 1 in a locked arrangement, in which locking tongue 21 is engaged behind locking hook 28. It can be appreciated from FIG. 2 that in this arrangement, compensating cushion 7 is relatively greatly deformed in the vicinity of its free end, such that due to the restoring force exerted on pressure guard plate 23 against the direction of insertion of shaft 29 into housing well 22, the shaft 29 is stressed only in tension.

It can further be seen from FIG. 2 that compensating cushion 7, by virtue of its elastic deformability in the longitudinal direction of shaft 29, creates a certain tolerance compensation for the positioning of the latter. In addition, the restoring force exerted by compensating cushion 7, and thus the strength of the engagement between locking tongue 21 and locking hook 28, can be adjusted relatively precisely by the positioning of shaft 29 in the longitudinal direction. A cam projection 32 attached to intermediate web 9 and extending in the direction of the front web serves a rear stop for front web 10.

It can further be understood from FIG. 2 that the unlocking lever 15 is provided with an articulation web 33, which extends from a reinforcing plate 34, which is disposed opposite tongue leaf 19, in the direction of base plate 3. Reinforcing plate 34 is connected via spacing webs 35 to tongue leaf 19. Configured at the end of articulation web 33 pointing away from reinforcing plate 34 is an articulation seat 36, which is in engagement with an abutment 37 formed on base plate 3. A stop lug 38 configured on tongue leaf 19 strikes the inner face of the autobody in the locked position. Anchoring feet 39 serve to fasten the hatch fitting 1 in at least one region opposite from fastening hook 4.

To release the locking hook 28, a pressure force is exerted on operating tongue 16 in the direction of base plate 3 against the spring force of lever spring tongue 20 until the engagement of locking tongue 21 with locking hook 28 is released. Immediately after the release of this engagement, compensating cushion 7 relaxes and moves hatch fitting 1 and autobody fitting 2 away from each other, such that in the exemplary embodiment described, the hood is a certain distance from the autobody and can be opened by hand.

Finally, also clearly evident in FIG. 2 are the fixing lips 26 mentioned in the explanation of FIG. 1, by means of which the shaft 29 of locking hook 28 can be positioned in the spacing increments—which are discrete in the exemplary embodiment—by engagement with the fixing ribs 30.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A lock for use in releasably locking a movable hatch to a counterpart, said lock comprising:

a first fitting positioned in one of the movable hatch and the counterpart, and having a first locking assembly;

a second fitting positioned in the other one of the movable hatch and the counterpart, and having a second locking assembly, said first and second locking assemblies engageable with one another, said first and second fittings made of a plastic material; an elastically, deformable cushion connected to one of said first and second fittings, said cushion disposed and deformable between said first and second fittings when said first and second fittings are engaged with one another whereby said cushion exerts a bias on said first and second fittings; and one of said first and second locking assemblies including an elongate locking element and the other one of said first and second locking assemblies including a locking tongue and an unlocking lever, said locking element lockingly engageable with said locking tongue and moveable out of engagement by the unlocking lever, said locking element adjustable within a plurality of spacing increments along a longitudinal direction of said locking element, said locking element including a shaft and a locking hook disposed al an end of said shaft, said shaft including a plurality of fixing ribs oriented transversely to said longitudinal direction, said fixing ribs engageable with tooth prolongations formed on said one of said first and second fittings.

2. The lock of claim 1, wherein said cushion is formed in one piece of an elastic material.

3. The lock of claim 2, wherein said cushion includes a plurality of webs, and at least one cushioning space defined between at least a pair of said webs.

4. The lock of claim 1, wherein said unlocking lever moves said locking tongue transversely with respect to a relative direction of movement of said fittings, between a locking position and a releasing position during locking of said lock.

5. The lock of claim 4, further comprising a lever spring element, said spring element engageable with said unlocking lever to hold said locking tongue in said locking position.

* * * * *